United States Patent [19]

Holland, Jr.

[11] 4,221,351

[45] Sep. 9, 1980

[54] KITES

[75] Inventor: Raymond P. Holland, Jr., Roswell, N. Mex.

[73] Assignee: The Holland Corporation, Roswell, N. Mex.

[21] Appl. No.: 896,044

[22] Filed: Apr. 13, 1978

[51] Int. Cl.[3] ..... B64C 31/06

[52] U.S. Cl. ..... 244/153 R

[58] Field of Search ..... 244/153, 155

[56] References Cited

U.S. PATENT DOCUMENTS

| | | | |
|---|---|---|---|
| 2,546,078 | 3/1951 | Rogallo et al. | 244/153 R |
| 2,931,600 | 4/1960 | Riker | 244/153 R |
| 3,767,145 | 10/1973 | Holland, Jr. | 244/153 R |
| 3,860,204 | 1/1975 | Checkley | 244/153 R |
| 4,029,273 | 6/1977 | Christoffel, Jr. | 244/135 R |
| 4,076,189 | 2/1978 | Powell | 244/153 R |

*Primary Examiner*—Galen L. Barefoot

[57] ABSTRACT

A kite for continuous and reliable flight without configuration change in winds ranging from light breezes to the strongest natural winds consists of a wind formed lifting surface in tension stabilized by a long thin trailing filament, such as a thin weighted cord or a thin metallic wire, the motions of which are damped by a minimum number of free-trailing flexible streamers.

4 Claims, 5 Drawing Figures

KITES

This invention relates to improvements in kites and has particular reference to a kite having a unique trailing tail, this kite being of very light weight and therefore being capable of flight in light breezes, and also being of great strength and stability, therefore being capable of flight in winds of hurricane force.

Modern technological uses of kites are beginning to require continuous flight whenever any significant amount of wind is present, unattended, and without adjustment or change of configuration. One such use, for example, requires flight from 8 miles per hour to 80 miles per hour. Prior to this invention, no known kite was capable of such a range of flight speeds. Any kite known to the writer having a sufficiently light weight structure to fly in a wind of 8 miles per hour, lacked the rigidity of form and the stability to fly in a wind of 80 miles per hour, at which speed the aerodynamic forces increase 100 fold. Now a kite of the present invention has already accomplished this requirement, and improvements have been tested which indicate that appreciably greater ranges of flight speed are attainable by the use of this invention.

The objects of this invention are:

To provide a kite: Capable of efficient, stable, high-angle flight in the strongest and gustiest winds likely to be encountered in natural meteorological conditions;

Having the least possible weight, to be able to fly efficiently in light breezes; and Having a trailing tail of unusually small aerodynamic drag and of light weight, producing a minimum burden on the lifting portion of the kite, yet capable of stabilizing the lifting portion in extremes of wind speed and turbulence.

To provide a kite which is inexpensive, durable, and easily replaceable, suitable for automated continuous flight operations for days, weeks, or months at a stretch, to be the flying component of a reliable all-weather kite system, at the minimum cost for purchase and maintenance, for such uses as routine meteorological wind measurements, monitoring wind speed, direction, and gustiness at relatively low elevations near airports for improved aircraft safety or for monitoring wind-borne pollution near potential sources of such pollution.

To provide such a kite which is sufficiently light and frangible to provide a minimum of risk to an aircraft from a possible collision with the kite.

Figure 1:
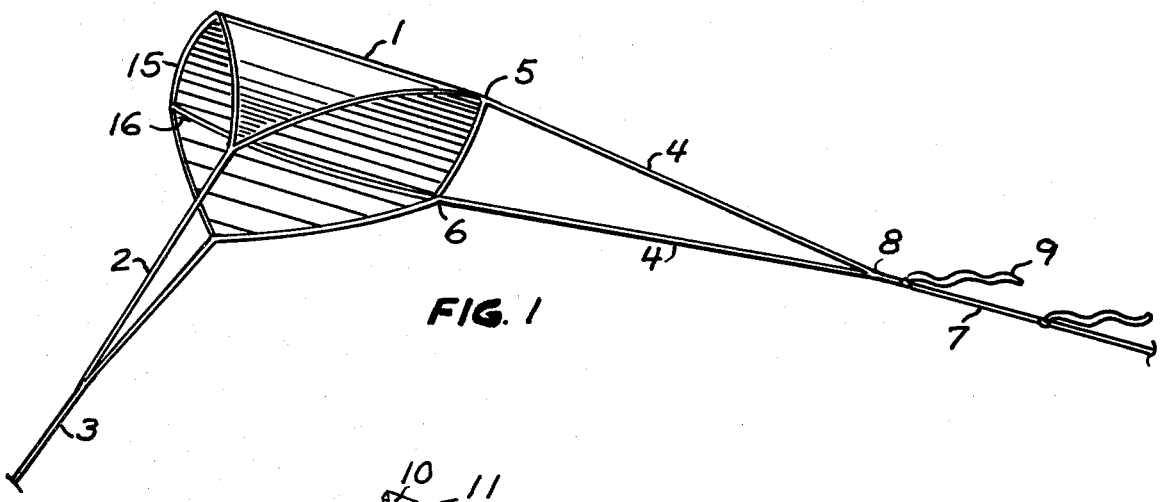
FIG. 1 shows a partial view of the kite of the present invention in flight, the end of the trailing tail not being shown.

This invention achieves its striking results primarily by reversing some accepted ideas about kite tails and how they work, and by applying the results of this concept-reversal to the existing type of kite lifting surface best suited to these modified concepts.

Although the use of a trailing tail has been successful in stabilizing kites since antiquity, never in those thousands of years has demand been placed on the kite tail to deliver its maximum performance.

The conventional teaching regarding kite tails states that the tail must produce wind resistance, so that the drag of the tail acting rearwardly at the rear of the kite keeps the kite faced into the wind. The use of extra weight on the kite tail, more often than otherwise, produces poor results. If the tail does not perform well, it should be made longer. This is the essence of the conventional teaching. It is inadequate to meet the needs satisfied by the present invention.

A review of existing kite tail art shows many forms, all of which are consistent with the conventional teaching. Essentially, drag-producing streamers are used. Typical forms include: (a) Short cross-strips of paper or cloth tied at close intervals along the entire length of a long cord, (b) Lengthwise strips of cloth proportioned perhaps 1 unit wide by 12 units long tied together near their ends producing a long ribbon having knots and short crosswise ends distributed more or less evenly along its length, (c) Long festoons, typically made of twisted cords with short cross-strips resembling bristles, standing out wooly-caterpillar fashion along its entire length, and (d) Long narrow ribbons of cloth or plastic without cross-strips, knots, or bristles.

In our development program to produce a modern all-speed all-weather full time kite we first attempted high speed kite flights using a conventional streaming tail of type (b) in the paragraph above. By using a long tail, we achieved stability in the strongest and gustiest natural winds which occurred, 50 to 55 miles per hour in peak gusts. Nevertheless, this tail was unable to meet our needs. It was so heavy and produced so much drag that the kite bearing it would not fly in the usual light and moderate winds. There was no airspeed at which the kite would fly efficiently at a steep upward angle above the horizon. The kite required re-trimming for best results at each different airspeed. The conventional tail simply dragged the kite downwind by brute force, low to the ground. It forced the kite into inefficient angles of attack. It largely eliminated the kite's useful lifting capacity, and destroyed the ability of the kite to climb steeply to elevations of interest. The conventional kite tail was proven to be an unbearable burden. We needed a stabilizing tail which, contrary to existing teaching, would not have much drag. Neither could it have much weight. The present invention meets those requirements.

To stabilize a kite at high speeds, contrary to the accepted teachings, the most important function of a streamer tail is not a drag force at the rear of the kite to keep the kite facing into the wind, but a downward component of force due to gravity at a low point on the kite to keep the kite right side up. The proof of this is that the kite must somehow "sense" and respond to the direction toward the earth. There is only one force which shows the downward direction. That is the force of gravity. It must be used.

Previous uses of weight to stabilize kites usually produced bad results, typically static aerodynamic instability around the kite's center of gravity, resulting in wild oscillations and autorotation. Consequently, the use of weight fell into disfavor. On the other hand, the use of drag on the kite tail cured the wild motions of the kite. Weight was charged with failure, and drag was credited with success. Actually weight was still performing its vital function, unacknowledged.

A simple trailing ribbon having very little weight per unit area, trailing out horizontally behind a kite, has no value for preventing that kite from rolling upside down at high speeds. Whatever trailing tail is used for that purpose must trail at an angle at least slightly downward from the horizontal behind the kite, so that the tension force exerted by the tail on the kite has an earthward component.

The downward component of force at the point where the kite tail attaches to the kite is the excess of tail weight over tail lift. To be able to fly in light breezes, it is desirable to make the weight of the tail small. It follows that the lift force on the tail must be eliminated so far as possible. Yet the necessary trailing angle of the tail, sloping downward to the rear, produces lift forces on any ribbon-like surface, and may cause lift on any stiff object attached to the tail. From this it follows that in order to avoid lift the backbone of the kite tail must not be a ribbon nor even a thick cord, but must be the thinnest possible filament, having the least practicable surface area. Any objects attached along the filament must avoid any non-yielding surfaces which could produce lift. They must be made of soft pliable material and be free to stream out horizontally, to avoid producing lift.

The conventional kite tail which we tested proved burdensome because in strong winds it was producing almost enough lift to support its weight. The small margin of weight in excess of lift was the only useful portion for the purpose of gravity sensing. As the tail was lenthened, the useful weight was increased, but at a very slow and inefficient rate. A large price in total weight and total drag was being paid for a small amount of useful weight.

This invention corrects these defects. The invention employs a trailing tail of a nonlifting type, which employs only as many streamers in the particular case as may be necessary to damp out excessive oscillations. Except for these few streamers the drag of the tail is kept to a minimum, because a small tail drag permits a correspondingly small tail weight to be employed. The smallest possible values of both weight and drag are to be accomplished if the tail is to cause the smallest adverse effects on kite performance. In any case there will be enough tail drag to accomplish the traditional kite tail function of keeping the kite facing toward the wind.

The criterion for success is neither weight nor drag, taken separately, but their ratio: Weight/Drag. The value of this ratio determines the angle at which the tail streams at its point of attachment behind the kite. If $\theta$ is the angle of the kite tail below the horizontal, D is the drag of the tail, L is the lift of the tail, W is the weight of the tail, V is the wind speed, and K is a drag constant, $\theta = \tan - 1(W\text{-}L)/D$. For a non-lifting tail, $L=0$, so that $\theta = \tan - 1W/D$. Also, $D = KV^2$ approx., so that $$\theta = \tan - 1\, W/KV^2 \quad (1)$$

Knowing the value of down-trail angle, $\theta$, necessary for right-side-up trim at the desired high speed, V, the value of the drag constant, K, is made as small as possible by using the thinnest filament, the fewest streamers, and the shortest length which will provide dynamic stability. The value of the least weight W which will accomplish the action is determined by solving equation (1). The trailing tail is made to weigh this much and no more.

The table below contrasts recommended kite tail practices, conventional versus the present teaching.

| | Quantity | Conventional | This invention |
|---|---|---|---|
| Item 1 | Drag | Make large | Make as small as possible |
| Item 2 | WT | (Ambiguous) | Make as small as possible, while satisfying Item 4 |
| Item 3 | Lift | (Ignored) | To be strictly avoided |
| Item 4 | Ratio: $\frac{Wt}{Drag}$ | (Ignored) | Make as large as needed for the particular case, by increasing W as necessary |

The novel kite tail just described senses the direction of gravity and applies corrective rolling moments on the kite. To achieve this effect with the least possible weight it is necessary that the kite be sensitive to the small moments exerted by the trailing tail. Although this type of tail may be used on any type of kite, its effectiveness is sensitively dependent on being combined in the proper way with the right sort of kite. The preferred kite will not have a large stabilizing gravity moment in itself such as is common with a box kite because a large gravity moment makes the kite relatively insensitive to the small moment delivered by the very light weight kite tail. Neither should the kite have large aerodynamic rolling moments such as may occur on a kite having a long wing subject to being deflected unsymmetrically in a strong wind. Such rolling moments may be too strong to be counteracted by the delicate correction applied by the light trailing tail. For such kites as the box kite and long span "airplane" kite a heavier tail is required. But addition of weight to the tail is contrary to the basic purposes of this invention.

The preferred kite does not make wide sweeping movements. Such movements generate additional air speed which may be destabilizing in strong winds. Any lateral oscillations of the kite should be of small amplitude. The kite, primarily, must be very light and rigid.

The type of kite which best satisfies these requirements is a wind-inflated kite of the general type described in U.S. Pat. No. 3,767,145 but not limited to that specific construction. This type of kite has strong static stability, small amplitude of lateral motion, short span, and is exceptionally light and clean aerodynamically. Being of a type which is held in shape by the forces of the wind itself it has a minimum of structural members. Its lifting surface is a sheet of flexible material held in shape only by the force of the wind and by two fore-and-aft support members, with the material in tension. This produces the lightest possible structure, a structure which is also very rigid. The only deflection which occurs is a slight stretching of the lifting surface material. This type of kite is shown at 1 in FIG. 1. Its form is downwardly concave in cross-stream section continuously from one lateral extremity of its lifting surface to the other lateral extremity. Such a form is close to ideal for avoiding aerodynamic rolling moments, the importance of which is described above.

In testing to determine whether a particular kite with its trailing tail is satisfactory for conditions of strongest natural winds, the effects of the natural turbulence which always accompanies strong winds must be taken into account. For example, in severe turbulence a wind-formed kite may be turned "wrong side out" by a gust. The type of flexible wind-formed kite used in this invention, being concave from one extreme lateral tip to the other, and being attached to the flying line only from these extreme tips, is able to reverse the concavity of its lifting surface without any mechanical interference. It flies equally well "wrong side out" and "right side out", because there is no mechanical difference between the two. It recovers flight reliably from any disturbed position, no matter how extreme. On the other hand, any flexible wind-formed kite employing a flying line, or a bridle attached to a flying line, between its extreme outer tips cannot successfully turn wrong side out, and cannot recover reliably from reversed positions. Its flying form becomes distorted by the tension of a line pulling from what, at that time, is the wrong side of the kite. Distortion, spinning and tangling occur, and the flight fails. For this and similar reasons, test techniques such as towing kites by automobile in still air are not satisfactory. A kite may be towed to a speed of 50 miles per hour behind an automobile without showing any bad tendency and yet the same kite may be unable to fly successfully in a natural gusty wind of 30 miles per hour. Similarly, the stability testing of free kites flying in wind tunnels to high speeds is not satisfactory because of the absence of large scale turbulence in the air stream. A method which serves as well as any to test for stability in the strongest natural winds is to tow the kite behind a light airplane in conditions of considerable natural turbulence. The turbulence in this case is not as great as in strong, natural winds but air speeds may be made greater so that a degree of compensation is achieved.

Now referring specifically to the drawing, the invention is shown in FIGS. 1 through 5. Kite (1) is of the type shown in U.S. Pat. No. 3,767,145. Flying bridle (2) for that kite attaches to flying line (3). A flexible V-shaped trailing bridle (4) attaches at the rear of kite (1) at points (5) and (6), separated from each other laterally. A long trailing filament (7) is attached at the vertex (8) of trailing bridle (4). Streamers (9) are attached to the trailing filament.

Trailing bridle (4) is long and forked, as shown, so that small lateral components of force at point (8) apply large yawing moments on kite (1), through points (5) and (6).

The forward portion (10) of the kite of this invention consists of kite (1) and bridle (2). The rearward portion (11) consists of trailing bridle (4), filament (7), and streamers (9).

Figure 2:
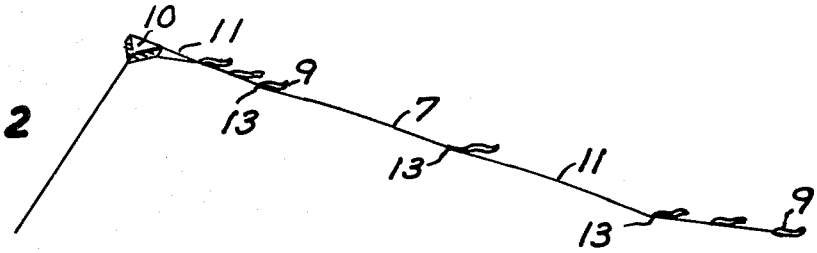
FIG. 2 shows a small scale view of the entire kite in one form of the invention which uses small weights at intervals along the tail.
Figure 3:
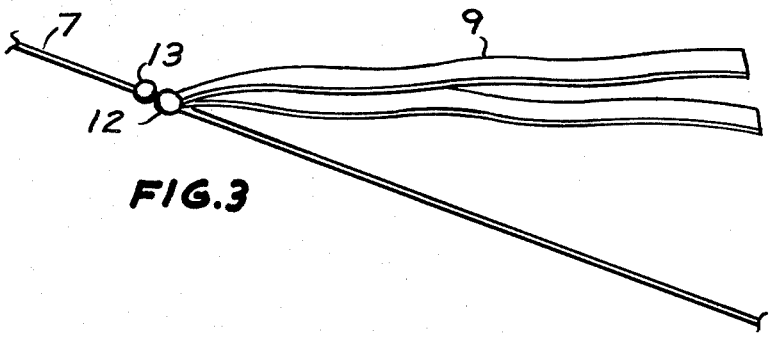
FIG. 3 shows a large scale view at one of the streamers of the kite of FIG. 2, showing one of these weights.
Figure 4:
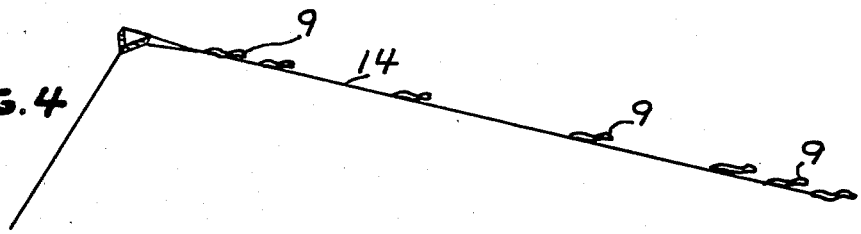
FIG. 4 shows a small scale view of the entire kite in a second form of the invention which uses a metal wire instead of weights.
Figure 5:
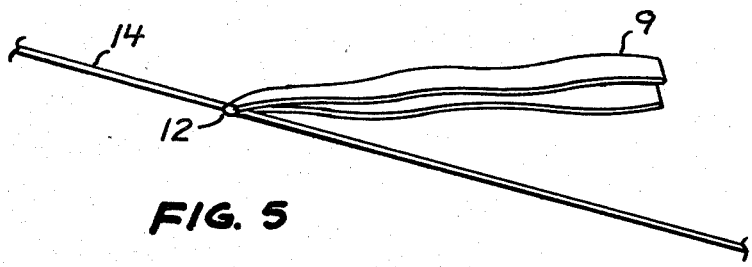
FIG. 5 shows a large scale view typical of all of the streamers on the kite of FIG. 4.

Alternate constructions of the rearward portion of the kite are shown in FIGS. 2 and 3 as contrasted to FIGS. 4 and 5. In both of these alternate constructions, streamers (9) are attached to the trailing filament at local points along the filament and each streamer trails free horizontally downwind.

Streamers (9) on the trailing tail are necessary to damp out dynamic oscillations in severely gusty wind. However, these streamers add drag, which must be kept to a minimum. Therefore, no more streamers are used than found to be absolutely necessary. An excessive number of streamers causes the tail to trail closer to the horizontal than would be the case if fewer streamers were used. The drag force tends to pull the tail to a position straight back downwind from the kite. Removal of streamers allows the tail to sag more.

It is important that none of the streamers present any non-yielding surfaces to the airstream because any force acting upwardly raises the entire tail and reduces its essential amount of downward streaming angle. Stiff members or members pulled taut by tension may also cause the tail to windmill and twist up and fail to operate properly.

Generally speaking, if the forward and rearward portions of the trailing tail are stabilized against excessive whip, the central portion of the tail stays in position. Therefore, streamers are located principally in two locations, (A) near the forward end where they tend to damp out sudden rushing movements of the kite and (B) near the rear end of the tail to prevent "snap the whip" motions. One or two streamers through the middle portion of the trailing filament may be added to improve the dynamics of a particular kite.

The most effective cure for dynamic problems is to use a longer trailing filament. Since this cure increases the weight and drag of the tail, overall success depends upon strict application of the construction described here to reduce drag and weight.

In FIGS. 2 and 3 the construction of the rearward portion of the kite consists of a trailing filament composed of a very thin, high-strength cord such as typically a cord of Du Pont's high strength Kevlar or a thin strand of braided nylon such as a high quality casting line for fishing. At various points along this trailing filament, small high-density weights are separately attached. That is, they are attached in separate and widely distributed positions. Typically such weights are small lead shots such as split shots clamped closed and tight around the filament. The weights are distributed along the filament so that their motions tend to average out and counteract each other. Location of weights close together would produce unfavorable dynamic effects by enabling too much mechanical energy to be stored locally.

In the construction in FIGS. 4 and 5 the trailing filament is a very thin metallic wire. With this construction no lead shots are used. Drag is at minimum. Weight is ideally distributed along the entire length of the tail, with no local weight concentrations. A typical, practical construction employs a thin copper wire. The reason for using metal is to attain the highest density with the least drag. Metal wire also prevents "twist-up" and resultant tail shortening.

The rearward portion of the kite occupies a position behind the kite, in a moderate hanging attitude, sloping downwardly to the rear. The use of the very small diameter cord or wire causes the drag of the rearward portion to be as small as possible. Similarly, the attachments of streamers (9) at local points with freedom to trail out horizontally causes them to produce a minimum of drag.

The construction of the overall kite is based upon developing all of the lift, so far as possible, on the forward portion and developing no lift, so far as possible, on the rearward portion. The very thin diameter of trailing filament (7) and the single point attachment and the free trailing property of streamers (9) accomplish these desired results.

The overall kite must have the least possible weight in order to achieve flight at the lowest possible wind speed while carrying a rearward portion of sufficient length to stabilize the kite in the turbulent air accompanying the strongest wind speeds. As mentioned above, the best type of lifting forward portion for this purpose is the type of kite (1) described in more detail in U.S. Pat. No. 3,767,145. This kite employs a laterally flexible lifting surface (15) in tension supported only by wind pressure and by two fore and aft support members (16).

Other styles of kites which share the desirable qualities which I have described here and at an earlier point in this specification may be used alternatively.

When lead shots (13) are used as in FIGS. 2 and 3, a streamer (9) is located at each such weight. The shot is clamped around filament (7) just forward of the attachment point (12) of streamer (9). In this position if the shot loosens it will simply slide rearward and will be stopped from moving further by the attachment of the streamer to the filament. The attachment of streamer (9) at point (12) is made compact so that its drag is small and so that it serves essentially as a pivotal attachment allowing the streamer to stand out horizontally in line with the air flow rather than having any stiffness which would hold it crosswise to the air flow.

Streamers (9) are tied close to filament (13) rather than being attached by a short length of flexible cord. Although such cord would assure a free trailing attitude it would be much less practical for operational use because it would increase the tendency for the streamers to tangle with each other and around the filament (7).

Streamers (9) are long and narrow. After weeks of flying in strong winds these filaments wear away. The long, narrow form increases the length of time the filaments are able to withstand erosion, increasing the useful life of the trailing portion of the kite before replacement is necessary.

By being separated laterally attachment points (5) and (6) together with V-shaped trailing bridle (4) provide a long lever arm for any lateral component of force made by filament (7) at attachment point (8). This enables the trailing rearward portion of the kite to sense gravity with a degree of magnification whenever the kite tends to fly off to one side. That is, whenever the flying line (3) departs from a vertical plane of symmetry, this sensing of gravity turns kite (1) back toward the vertical plane and provides a high degree of lateral stabilization.

In very strong winds when the stabilization forces transmitted to the forward portion of the kite may be only fractions of ounces and when the tension in flying line (3) may be in the order of 20 pounds some slight dysymmetry may appear in kite (1) which would cause it to veer to one side, out of the vertical plane of symmetry. This may occur despite the most accurate manufacturing and the best selection of materials because of the inherent imperfection and nonuniformity of all materials and constructions when they are carried to their utmost limits. Therefore, an adjustment may be made experimentally for each particular high-speed kite, by sliding attachment point (8) along bridle (4) very slightly toward attachment point (5) (if kite (1) must be corrected to fly more to the left) or toward point (6) (if kite (1) is to be adjusted to fly more to the right).

I claim:

1. A kite consisting of a light weight, compact, lifting forward portion, and a long, light weight, low drag, gravity-sensing rearward portion; said forward portion comprising a single lifting surface downwardly concave continuously from one of the lateral extremities of the kite to the opposite lateral extremity of the kite, said single concave lifting surface producing essentially all of the lift of said kite, said lifting surface consisting of a laterally flexible wind-formed sheet in tension attached to two upper ends of a flying bridle at locations limited to one point of attachment at each of the two lateral extremities of said lifting surface; and said rearward portion comprising a thin trailing filament, the overall length of said filament exceeding ten times the maximum fore and aft chord length of said lifting surface, free trailing low drag streamers attached to said trailing filament, said streamers being sparsely spaced such that the overall length of said filament greatly exceeds the total length of all of said streamers attached thereto; the combination of said long thin filament and said sparsely spaced low drag streamers producing an extra long downwardly angling trailing tail having unique minimal drag; said trailing tail in combination with said lifting forward portion producing stabilizing actions resulting in marked increases in wind speeds and turbulence at which light weight kites are able to perform efficient stabilized flight.

2. In a kite according to claim 1, said filament consisting of a thin metallic wire.

3. In a kite according to claim 1, at least two small high density weights attached individually at widely separated locations to said filament.

4. A kite comprising a single light weight wind-formed flexible sheet lifting surface downwardly concave continuously from one of the lateral extremities of the kite to the opposite lateral extremity of the kite, said single lifting surface producing essentially all the lift of the kite, a flexible V-shaped tail bridle attached to said lifting surface at two attachment points widely separated laterally from each other, a long thin trailing filament attached to the vertex of said tail bridle, the length of said filament exceeding ten times the maximum fore and aft chord length of said lifting surface, low drag free trailing streamers attached to said trailing filament, said streamers being sparsely spaced such that the overall length of said filament greatly exceeds the total length of all of said streamers attached thereto, the combination of said long thin filament and said sparsely spaced low drag streamers forming a long trailing tail having unique minimal drag, and the combination of said trailing tail with said lifting surface and said tail bridle resulting in marked increases in wind speeds and turbulence at which light weight kites are able to perform efficient stabilized flight.

* * * * *